US006357566B1

(12) United States Patent
Pond

(10) Patent No.: US 6,357,566 B1
(45) Date of Patent: Mar. 19, 2002

(54) CARRY-ON CASE

(75) Inventor: Gary E. Pond, South Bend, IN (US)

(73) Assignee: Porter Case, Inc., South Bend, IN (US)

( * ) Notice: Subject to any disclaimer, the term of this patent is extended or adjusted under 35 U.S.C. 154(b) by 0 days.

(21) Appl. No.: 09/588,769

(22) Filed: Jun. 6, 2000

(51) Int. Cl.[7] ..... A45C 13/26
(52) U.S. Cl. ..... 190/18 A; 190/115
(58) Field of Search ..... 190/39, 115, 18 A; 16/113.1

(56) References Cited

U.S. PATENT DOCUMENTS 5,116,289 A 5/1992 Pond ..... 190/18 A
5,368,143 A 11/1994 Pond ..... 190/18 A
5,385,220 A 1/1995 Pond ..... 190/18 A

*Primary Examiner*—Stephen P. Garbe
(74) *Attorney, Agent, or Firm*—James D. Hall; Ken C. Decker

(57) ABSTRACT

A carry-on case having a base and a connected lid. A handle is pivotally carried by the lid and is shiftable between a lowered position overlying the lid and a raised position extending upwardly from the lid. The handle is extendable between a collapsed position in which the grip of the handle is next to the lid and an extended position in which the grip is substantially spaced from the lid. Wheels are carried by the base. The handle includes releasable lock pins which extend upwardly and downwardly from a cross brace forming a part of the handle and which serve to secure the handle in either of its extended or collapsed positions. When the handle is in its collapsed position, the upwardly extending lock pins are enclosed by the handle leaving the lower extending lock pins available to release the handle for its extendable movement.

5 Claims, 5 Drawing Sheets

CARRY-ON CASE

SUMMARY OF THE INVENTION

This invention relates to a carry-on case having an extendable and retractable handle and will have specific application to a locking device by which the handle may be secured in a fully collapsed position or released into extended positions.

The carry-on case of this invention includes a base and a connected lid. The base carries wheels and a handle is pivotally carried by the lid. The handle is shiftable relative to the lid between a lowered position overlying the lid and a raised position extending upwardly from the lid. The handle is extendable between a collapsed position in which the grip part of the handle is adjacent the lid and an extended position in which the grip part is substantially spaced from the lid and base while the handle is in its lowered position. The handle includes a releasable lock formed of upwardly and downwardly extending pin parts each accessible when the handle is in an extended position. When the handle is collapsed, the grip part covers the upwardly extending pin parts. The downwardly extending pin parts are then utilized to release the handle from its collapsed position for movement into its extended positions.

Heretofore, as shown in U.S. Pat. No. 5,368,143, the grip part of the handle when the handle is secured in its collapsed position was slightly spaced from the handle cross brace, adjacent the lid of the case. While this would enable the user of the carry-on case to carry the case by gripping the spaced but collapsed handle at its grip part, it also provided a ready means by which baggage handlers should the case be checked during airplane flights could easily throw the case during handling. Such handling was prone to damaging the case. In this invention the releasable lock for the handle has been improved so as to enable the grip part of the handle to be located snugly against the case in a locked position thus providing no ready means by which a baggage handler may use the handle grip part for locating the case.

Accordingly, it is the object of this invention to provide an improved carry-on case in which the extendable handle used to pull the case may be fully secured in a collapsed position against the case.

Other objects of this invention will become apparent upon a reading of the following description.

DESCRIPTION OF THE PREFERRED EMBODIMENT

The description of this invention incorporates components and parts used extensively in U.S. Pat. Nos. 5,368,143 and 5,116,289, both of which are incorporated herein by reference. Case 10 includes a housing formed by a base 12 and a lid 14 both of which are connected and held together by hinges. Case 10 also includes two wheels 30 and a handle 40 that is releasably extendable, collapsible, lowerable and raiseable. Lid 14 is shiftable about its hinges from an open position to a closed position. Wheels 30 (only one shown) are positioned on opposite sides of the base and are journalled upon an axle member.

Figure 1:
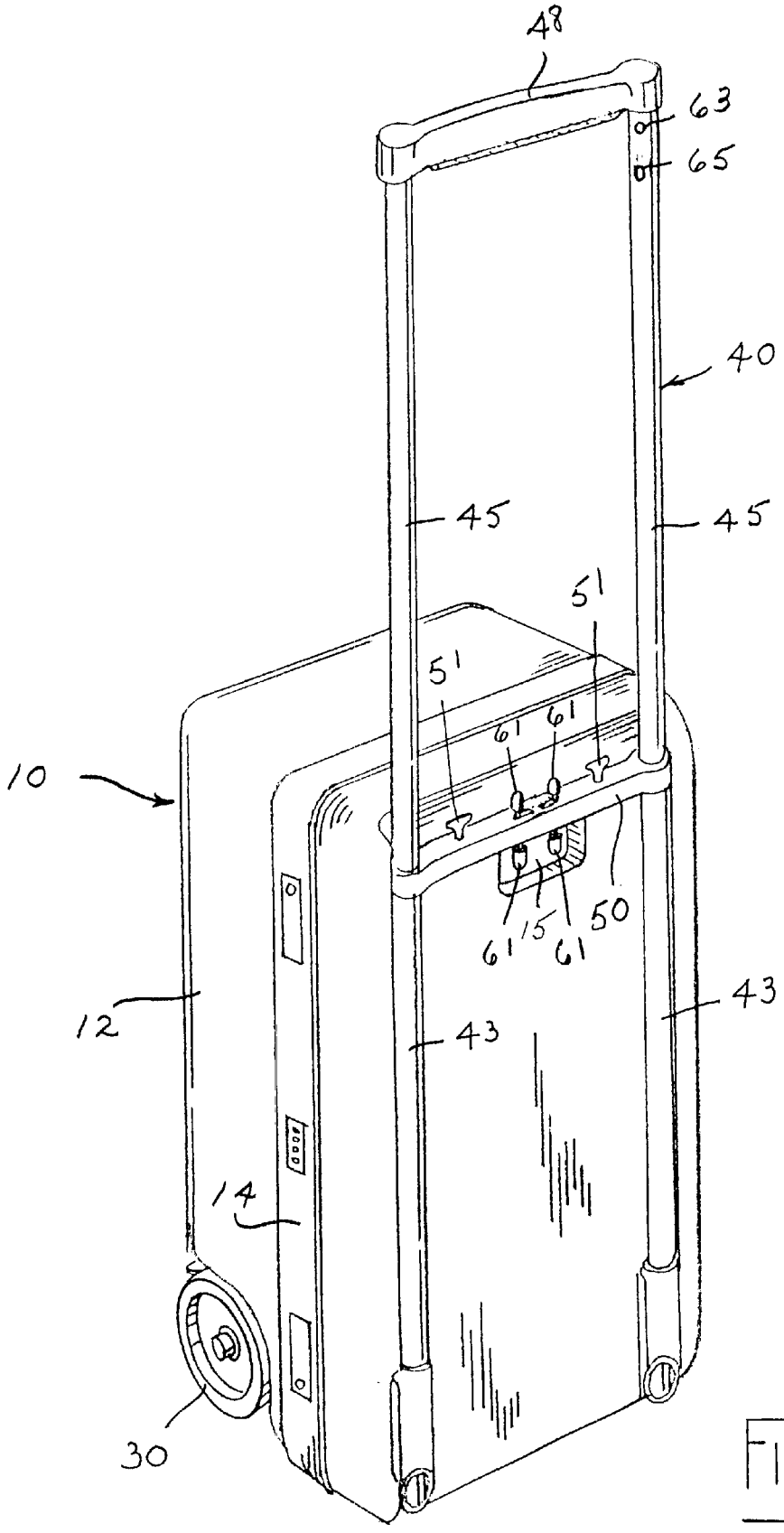
FIG. 1 is a perspective view of the carry-on case shown with its handle in its extended position.
Figure 2:
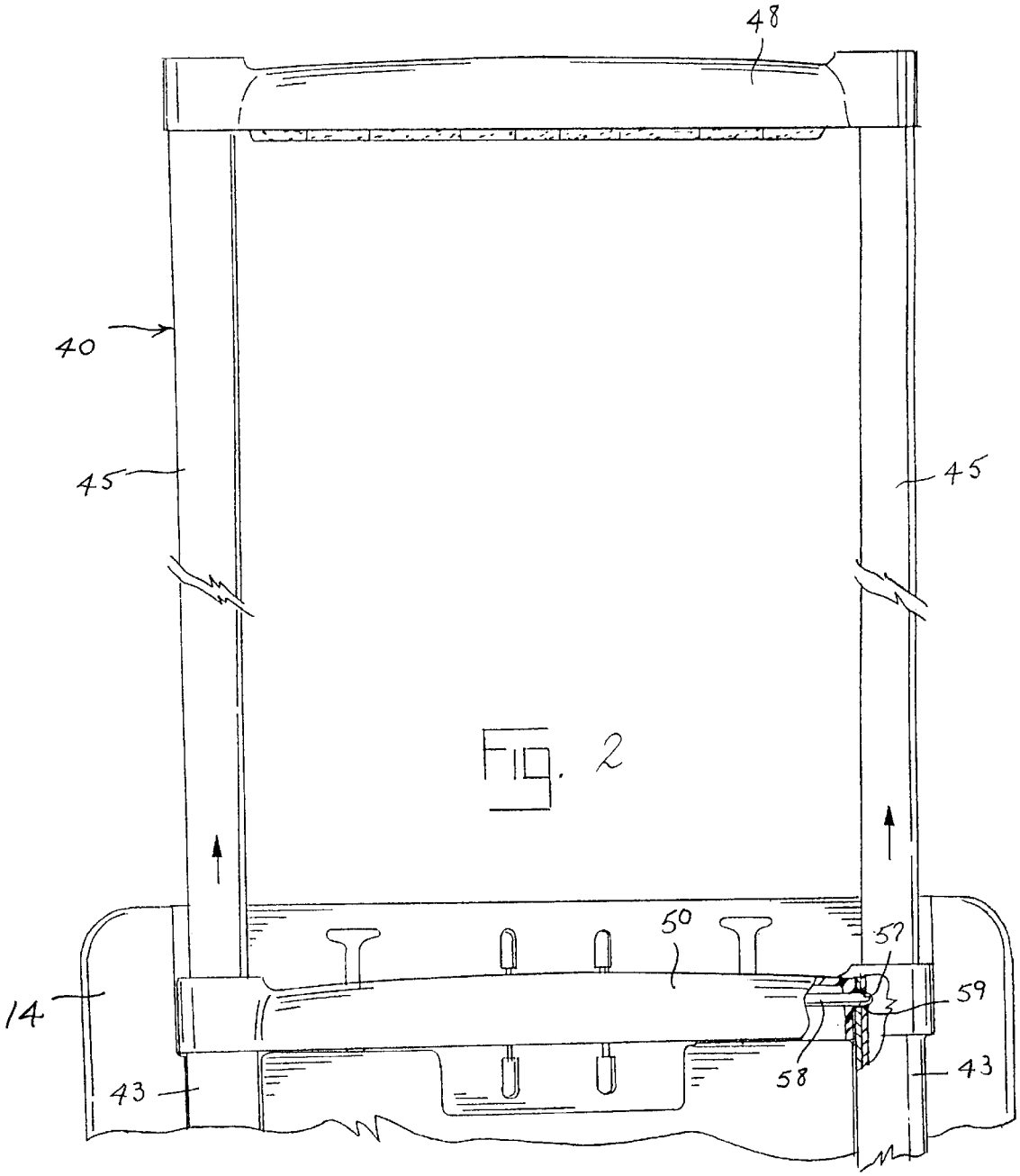
FIG. 2 is a fragmented view of the carry-on case shown with its handle extended and with portions thereof broken away for illustrative purposes.
Figure 4:
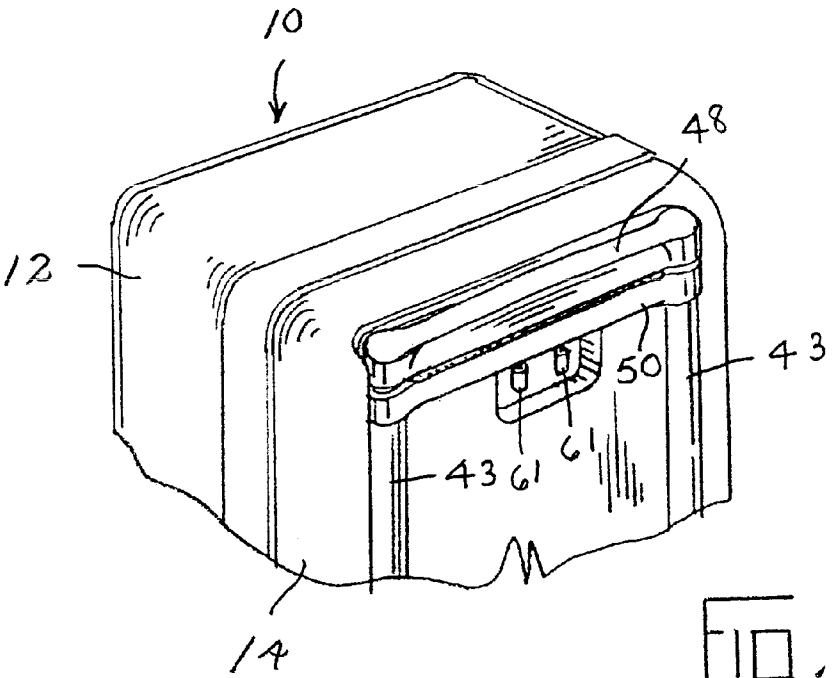
FIG. 4 is a fragmentary perspective view of the carry-on case shown with its handle in its collapsed position.
Figure 3:
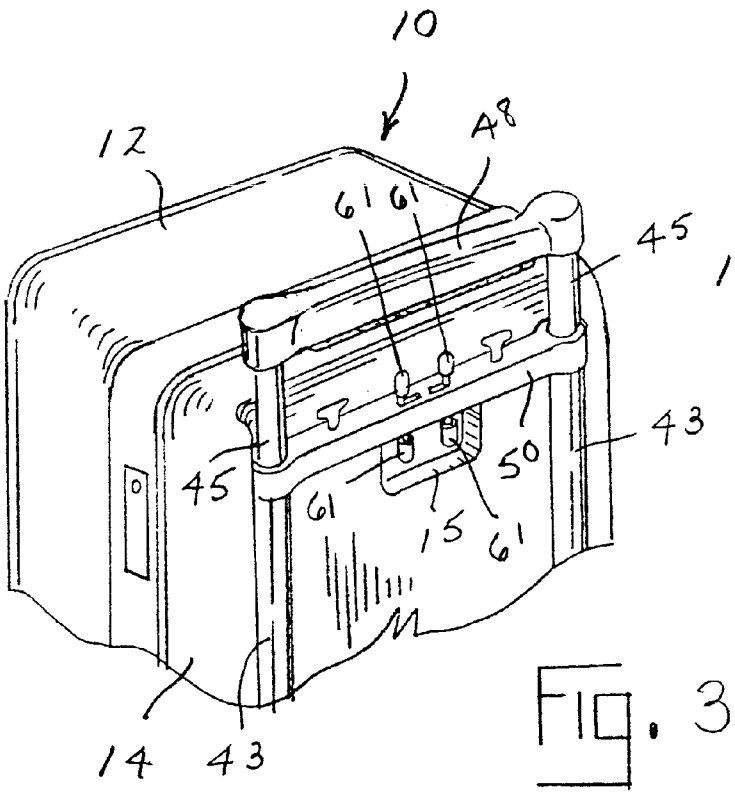
FIG. 3 is a fragmentary perspective view of the carry-on case shown with its handle in an intermediate extended carry position.
Figure 5:
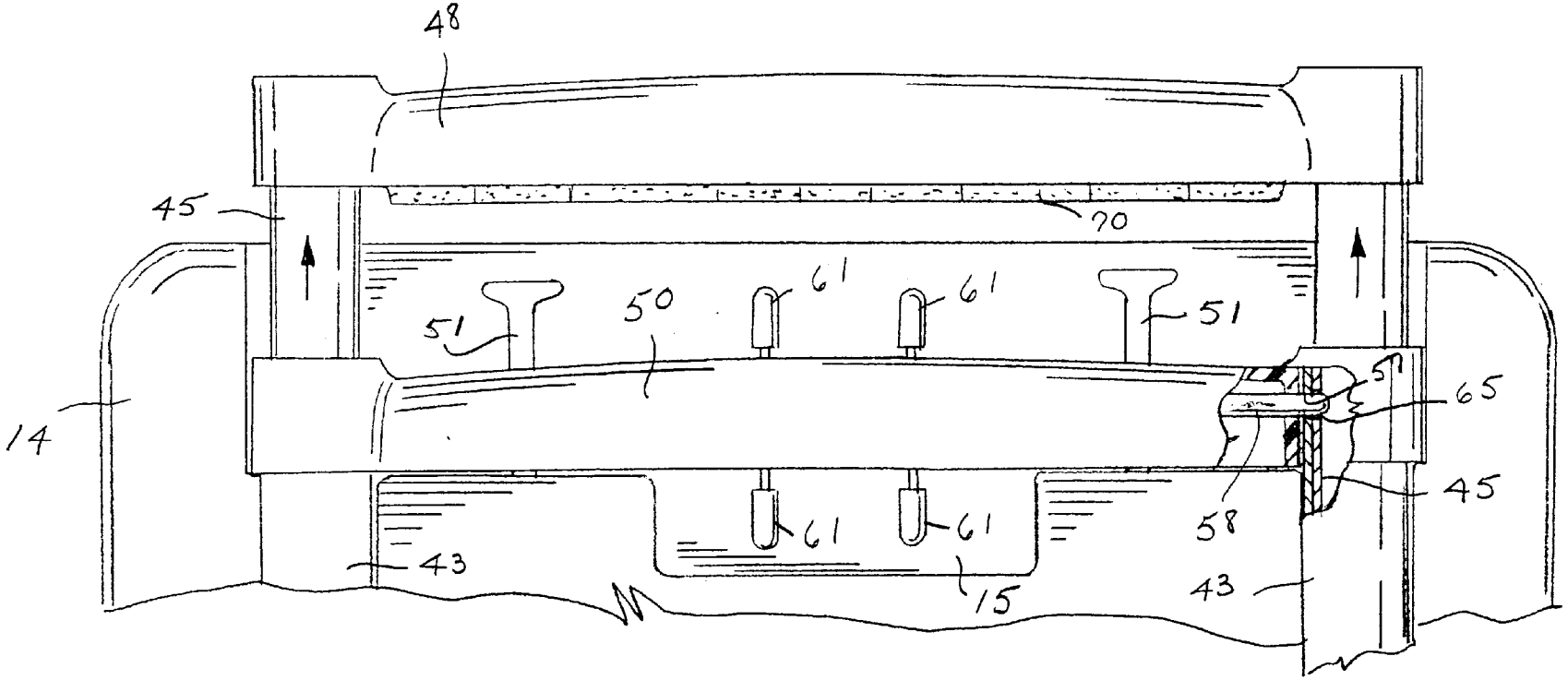
FIG. 5 is a fragmentary view of the carry-on case shown with its handle in its carry position and with portions thereof broken away for illustrative purposes.
Figure 6:
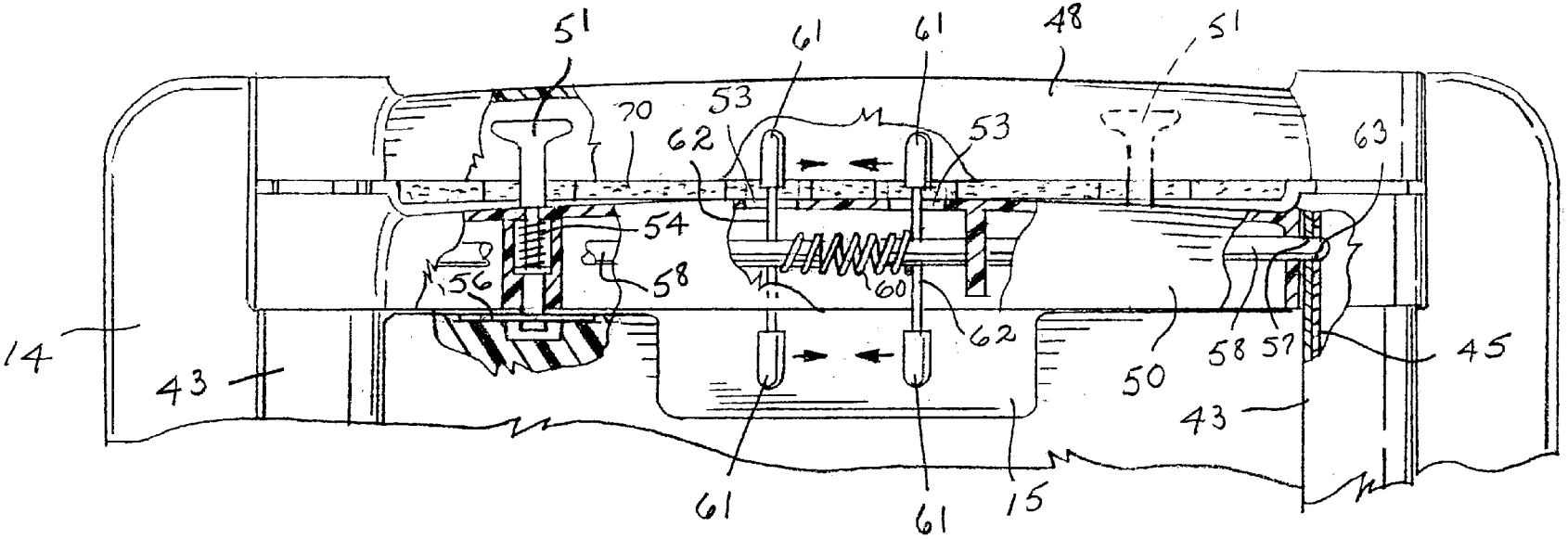
FIG. 6 is a fragmentary view of the carry-on case shown with its handle in its collapsed position and with portions thereof broken away for illustrative purposes.

Handle 40 of the case includes two parallel side rails each of which is formed of an outer telescopic member 43 and an inner telescopic member 45. Outer telescopic members 43 are joined at opposite corresponding ends by a cross brace 50 and are each connected to lid 14 at their opposite corresponding ends by a pivot rod. Alternatively, member 43 may be pivotally connected to the base. A hand grip 48 is connected to inner telescopic numbers 45 of handle 40 at their free ends. The inner telescopic members 45 are shiftable relative to the outer telescopic members 43 to allow handle 40 to assume the collapsed position as seen in FIGS. 4 and 6 and the extended position as seen in FIGS. 1 and 2. Additionally, the handle can assume an intermediate extended position in which the hand grip 48 is secured in an intermediate carry position as seen in FIGS. 3 and 5 adjacent lid 14 when the handle is in its lowered position.

Handle 40 is shiftable between a lowered position against the lid and a raised position extending upwardly from the lid as seen and described in U.S. Pat. Nos. 5,368,143 and 5,116,289. Handle 40 is selectively secured in its collapsed position, extended position or intermediate carrying position by means of a locking system which is housed in and carried by cross brace 50. This locking system includes two lock rods 58 which are oppositely extending and axially aligned. The lock rods which are retained within the cross brace 50 protrude through guide holes 57 formed in the inside of the outer telescopic members 43 and aligned set of lock holes 59 in the inner telescopic members 45. Each of the lock rods 58 can be retracted out of the lock holes 59 to permit the inner telescopic members to shift relative to the outer telescopic members and thus permit the retraction of the handle.

Lock rods 58 are normally urged outwardly into a protruding position relative to lock holes 59 by a helical spring 60. Helical spring 60 abuts at each of its ends in compressive engagement a transverse pin 62 which is press-fitted through each lock rod 58. Each pin 62 extends from opposite sides of cross brace 50 and through an oblong slot 53 in the brace. By squeezing the two opposite exposed end parts 61 of pins 62 on either side of cross brace 50, helical spring 60 is compressed and lock rods 58 are drawn together to withdraw the outer ends of the lock rods from the lock holes 59 in the inner telescopic members 45 to free handle 40 for its retractive movement.

Inner telescopic members 45 have two other sets 63 and 65 of aligned lock holes. Lock holes 63 in the inner telescopic members 45 are adjacent the outer most ends of the members and configured to receive lock rods 58 when the handle is in its collapsed position. Lock holes 65 are slightly spaced from lock holes 63 and when receiving the ends of lock rods 58 serve to secure the handle in an extended carrying position slightly spaced from the case base and lid so as to enable the hand grip 48 to be utilized as a carrying handle by the user of the case. In either the extended position or the carrying position of the handle, both protruding end parts 61 of pins 62 are accessible to the user of the case and thus either pair of opposed pin end parts may be used to release the lock rods 58 to allow shiftable movement of the handle. When handle 40 is secured in its collapsed position with lock rods 58 protruding into lock holes 63 in inner telescopic members 45, the handle is fitted essentially against lid 14 with the hand grip 48 covering the end parts 61 of pins 62 which protrude from the cross brace 50 toward the hand grip. To free the handle from its collapsed position, only the oppositely extending end parts 61 of pins 62 are accessible to the user within recess 15 in lid 14. A foam member 70 which is carried by hand grip 48 provides not only a gripping surface for the user but also an absorbent for the handle when it is placed in its collapsed position. In this position, member 70 is squeezed or compressed between hand grip 48 and cross brace 50 so as to provide shock absorbing movement for the handle when it is moved into its collapsed position as well as tension between the hand grip and cross brace, thus reducing any interplay between lock rods 58 and inner telescopic members 45 at lock holes 63.

Handle 40 is secured in its lowered position against lid 14 by releasable lock pins 51 carried by cross brace 50. A spring 54 causes each lock pin 51 to be biased over a strike plate 56 attached to lid 14 and into a recess in the lid. To free handle 40, the lock pins 51 need only be pulled outwardly which compresses springs 54 and withdraws the pins from the lid.

The above invention is not to be limited to the details as described but rather may be modified within the scope of the appended claims.

What I claim is:

1. A carry-on case comprising a base and a connected lid, said lid being shiftable relative to the base between an open position exposing the interior of the base and a closed position overlying the base, wheels carried by said base, a handle carried by said lid and being shiftable relative to the lid between a lowered position overlying the lid and a raised position extending upwardly from the lid, said handle including extendable spaced side rails inter-connected at corresponding ends by a hand grip, said handle having a collapsed position in which the hand grip is next to said lid and an extended position in which the hand grip is substantially spaced from the lid while in its said lowered position, said handle including a releasable lock engageable with said handle side rails to secure said handle in either its collapsed position or its extended position, said lock including a pin having oppositely extending first and second end parts each accessible when said handle is in its extended position, said hand grip covering said first end part when said handle is in its collapsed position with only the second end part being accessible for usage, said first and second end parts serving as means for permitting the handle to shift between its extended and collapsed positions.

2. The carry-on case of claim 1 where in each handle side rail includes two telescopic sections and a cross brace, one said telescopic section connected to one of said lid or said base, the other telescopic section connected to said hand grip, said brace connected between said one telescopic section of one said handle side rail and said one telescopic section of the other said handle side rail, said brace carrying said pin, said end parts of said pin protruding oppositely from said brace, said hand grip located next to said brace and overlying said first end part when said handle is in its collapsed position.

3. The carry-on case of claim 2 wherein said brace lies against said lid when said handle is in its lowered position.

4. The carry-on case of claim 2 and a resilient member carried by said handle between said hand grip and said brace, said resilient member being compressed between said hand grip and brace when said handle is in its collapsed position.

5. The carry-on case of claim 2 whereas said handle has an intermediate position between its said extended position and said collapsed position, said first and second end parts being accessible for use when said handle is in its said intermediate position.

* * * * *